US006171554B1

(12) United States Patent
Kalmakis et al.

(10) Patent No.: US 6,171,554 B1
(45) **Date of Patent: *Jan. 9, 2001**

(54) APPARATUS AND METHOD FOR ALPHANUMERICALLY IDENTIFYING AND ARRANGING TEST TUBES

(75) Inventors: George P. Kalmakis, Reading; R. Laurence Keene, N. Andover, both of MA (US)

(73) Assignee: Matrix Technologies Corporation, Hudson, NH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/720,723

(22) Filed: Oct. 2, 1996

(51) Int. Cl.[7] ..... B01L 9/00; B65D 85/20

(52) U.S. Cl. ..... 422/104; 422/99; 422/913; 422/915; 206/443

(58) Field of Search ..... 422/913, 915, 422/104, 99; 206/443

(56) References Cited

U.S. PATENT DOCUMENTS

| | | | | |
|---|---|---|---|---|
| 3,818,188 | | 6/1974 | Hertel et al. . | |
| 4,284,603 | * | 8/1981 | Korom | 422/101 |
| 4,431,924 | | 2/1984 | Suovaniemi et al. | 250/566 |
| 4,472,357 | | 9/1984 | Levy et al. | 422/102 |
| 4,510,119 | * | 4/1985 | Hevey | 422/71 |
| 4,665,553 | | 5/1987 | Gershman et al. | 356/39 |
| 4,787,523 | * | 11/1988 | Kalous | 211/74 |
| 4,898,278 | * | 2/1990 | Leoncavallo | 206/443 |
| 5,009,316 | * | 4/1991 | Klein | 206/443 |
| 5,048,957 | | 9/1991 | Berthold et al. | 356/246 |
| 5,096,672 | | 3/1992 | Tervamäki et al. | 422/102 |
| 5,098,661 | | 3/1992 | Froehlich et al. . | |
| 5,112,682 | * | 5/1992 | Inouye et al. | 428/353 |
| 5,357,095 | | 10/1994 | Weyrauch et al. . | |
| 5,397,542 | | 3/1995 | Nelms et al. . | |
| 5,397,709 | * | 3/1995 | Berndt | 436/34 |
| 5,420,408 | | 5/1995 | Weyrauch et al. . | |
| 5,427,743 | | 6/1995 | Markin . | |
| 5,470,536 | | 11/1995 | Järvimäki | 422/102 |
| 5,595,708 | * | 1/1997 | Berndt | 422/82.06 |

* cited by examiner

*Primary Examiner*—Bennett Celsa
(74) *Attorney, Agent, or Firm*—Samuels, Gauthier & Stevens

(57) ABSTRACT

A method of identifying and arranging test tubes, which includes providing a rack having an array of wells located at the intersection of mutually perpendicular columns and rows. The columns and rows are aligned on perpendicular edges of the rack. The test tubes are positioned in the wells and then marked with indicia to correspond to the location of the respective wells.

20 Claims, 5 Drawing Sheets

APPARATUS AND METHOD FOR ALPHANUMERICALLY IDENTIFYING AND ARRANGING TEST TUBES

BACKGROUND OF THE INVENTION

1. Field of the Invention

This invention relates to laboratory technology and specifically to a new and improved rack of test tubes suitable for use in diagnostic methods.

2. Background of the Invention

It is known to provide multi-well racks for test tubes. Conventionally, the wells are located at the intersections of mutually perpendicular columns and rows aligned with alphanumeric markings along perpendicular edges of the rack. Test tubes are supported in the wells. Often during use, the tubes are not labeled. Thus, if more than one tube is removed from the rack at one time, errors may be made when returning the tubes to the proper wells. At other times the tubes are manually marked with the appropriate alphanumerical designation to identify their appropriate positions in the array of wells. In addition to being time consuming and laborious, this practice can also lead to errors caused by laboratory technicians either mislabeling the tubes or again, returning properly labeled tubes to the wrong wells.

SUMMARY OF THE INVENTION

The present invention avoids these problems by simultaneously marking all of the test tubes in a given rack with the alphanumeric indicia corresponding to the alphanumeric locations of the wells in which the tubes are supported.

Advantageously, the wells are open bottomed to expose the lower tube ends, and the alphanumeric markings are applied to the thus exposed tube ends.

Preferably, the rack is provided with a detachable lid which serves to retain the tubes within their respective wells during application of the alphanumeric markings to their exposed lower ends.

DETAILED DESCRIPTION OF THE PREFERRED EMBODIMENTS

Figure 1:
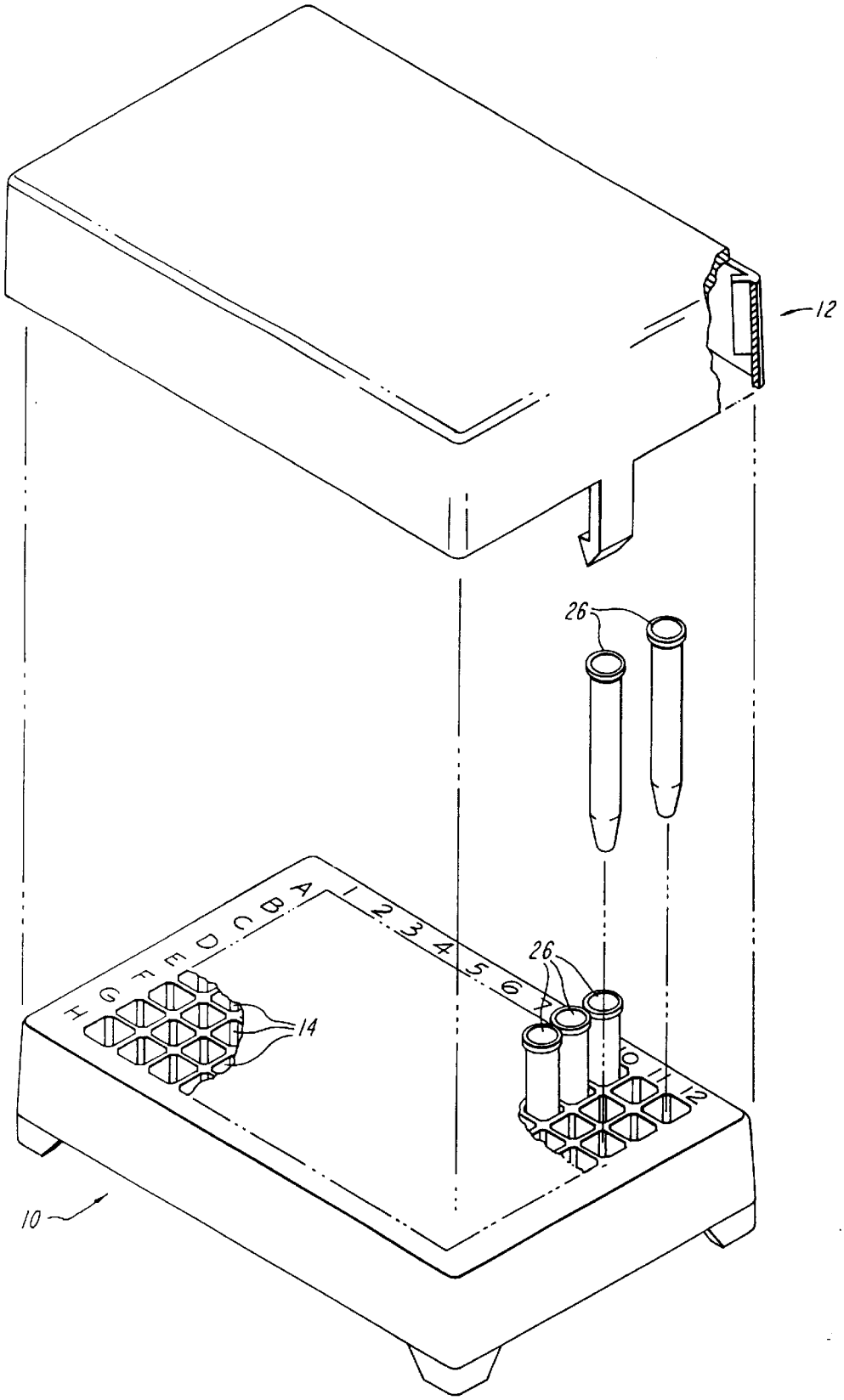
FIG. 1 is a view of a rack of tubes in accordance with the present invention with the lid and several individual tubes depicted in an exploded relationship.
Figure 2:
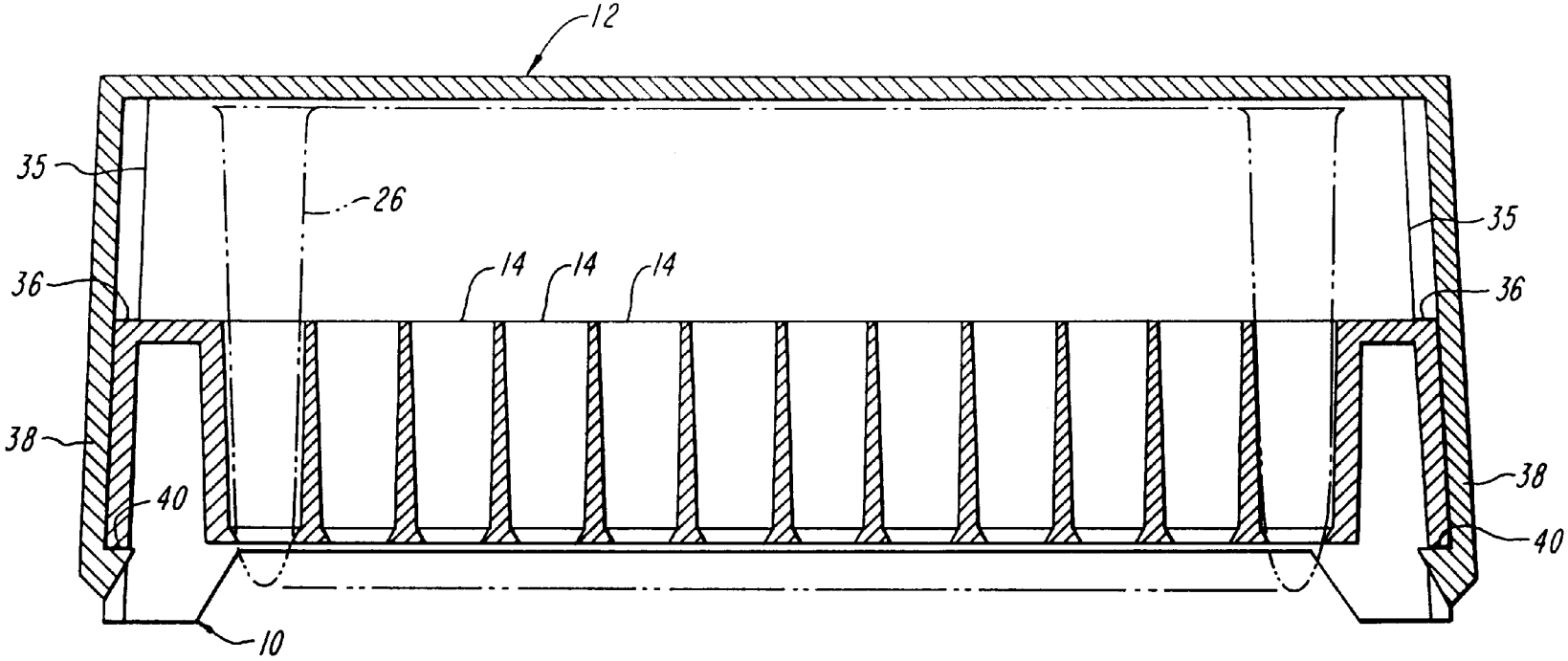
FIG. 2 is an enlarged cross-section of the rack and assembled lid.
Figure 3:
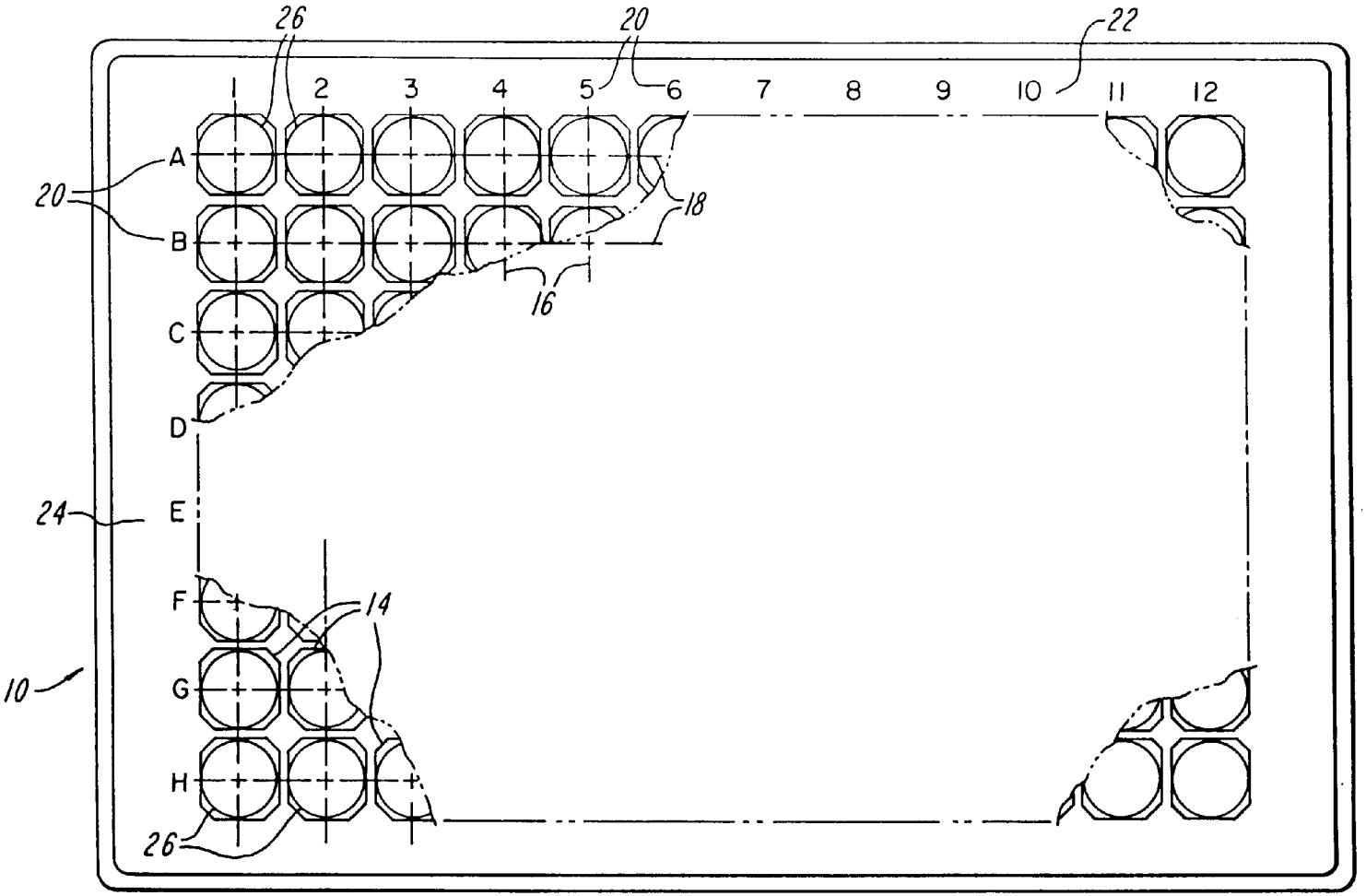
FIG. 3 is a top plan view of the rack of tubes with the lid removed.

Referring initially to FIGS. 1–4, a rack of tubes in accordance with the present invention is shown generally at 10 with its associated lid 12. The rack 10 includes wells indicated typically at 14. As shown in FIG. 3, the wells 14 are located at the intersections of mutually perpendicular columns 16 and rows 18 aligned with alphanumeric markings 20 along perpendicular edges 22, 24 of the top surface of the rack. In the illustrated embodiment, each row 18 is labeled with a letter of the alphabet and each column 16 is labeled with a number, i.e. A, B, C, and 1, 2, 3, respectively to define the position of each well 14.

Figure 4:
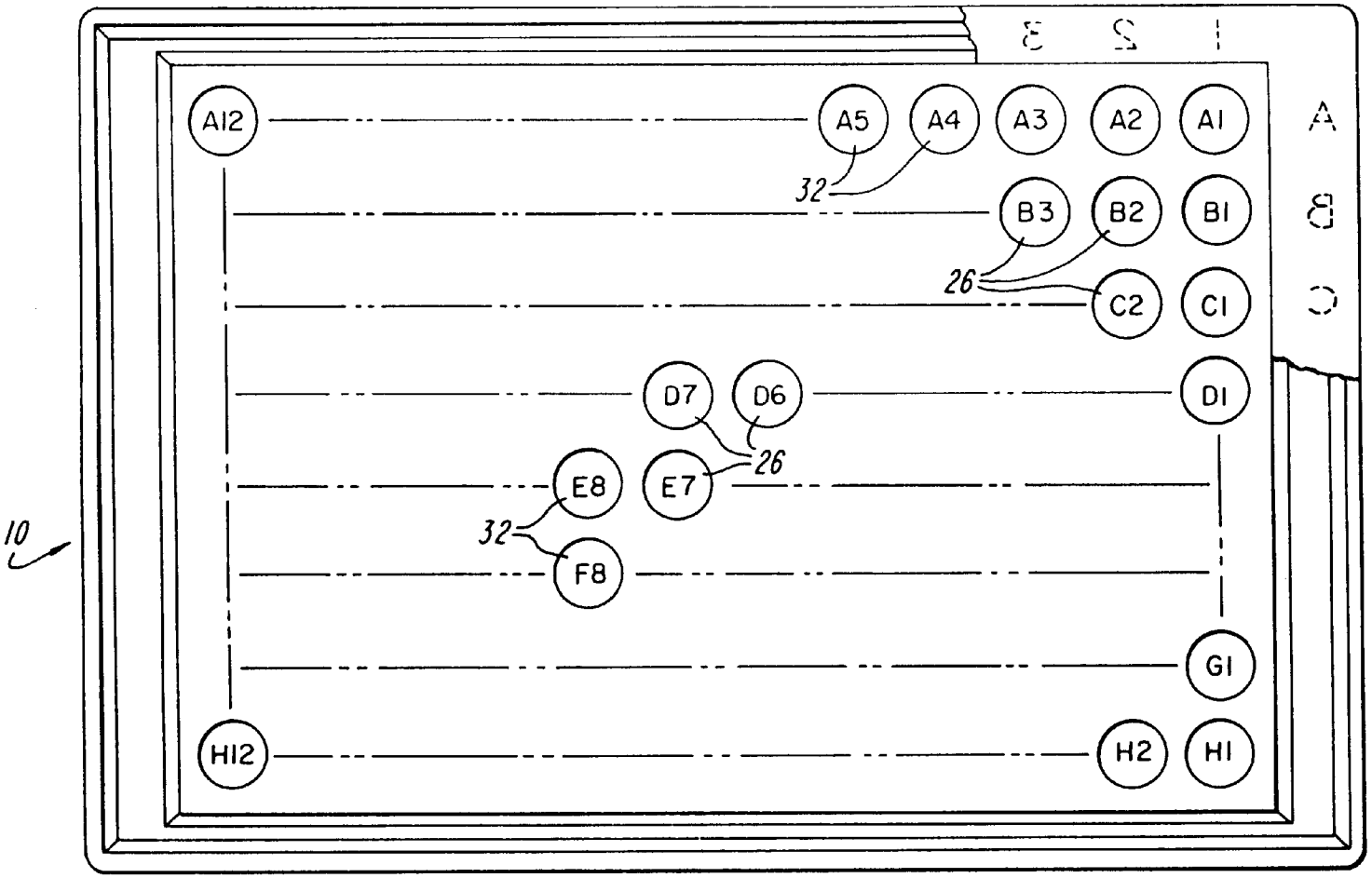
FIG. 4 is a bottom plan view of the rack of tubes.

The wells 14 are configured and dimensioned to support test tubes indicated typically at 26. The bottom ends of the test tubes protrude through the open bottoms of the wells and are thus exposed, as shown in FIGS. 2 and 4. The exposed tube ends are marked, as by printing, with alphanumeric indicia indicated typically at 32 corresponding to the alphanumeric locations of the wells in which the tubes 26 are supported. The lid 12 is detachably mounted on the rack 10 to keep the tubes 26 in place, both during as well as after applying the indicia 32 to the tube ends.

The lid 12 includes internal corner ribs 35 which abut the upper surface of the rack 10 as at 36 to provide a positive locating function. Resilient locking tabs 38 mechanically engage the rack as at 40 to detachably secure the lid in place.

Figure 5:
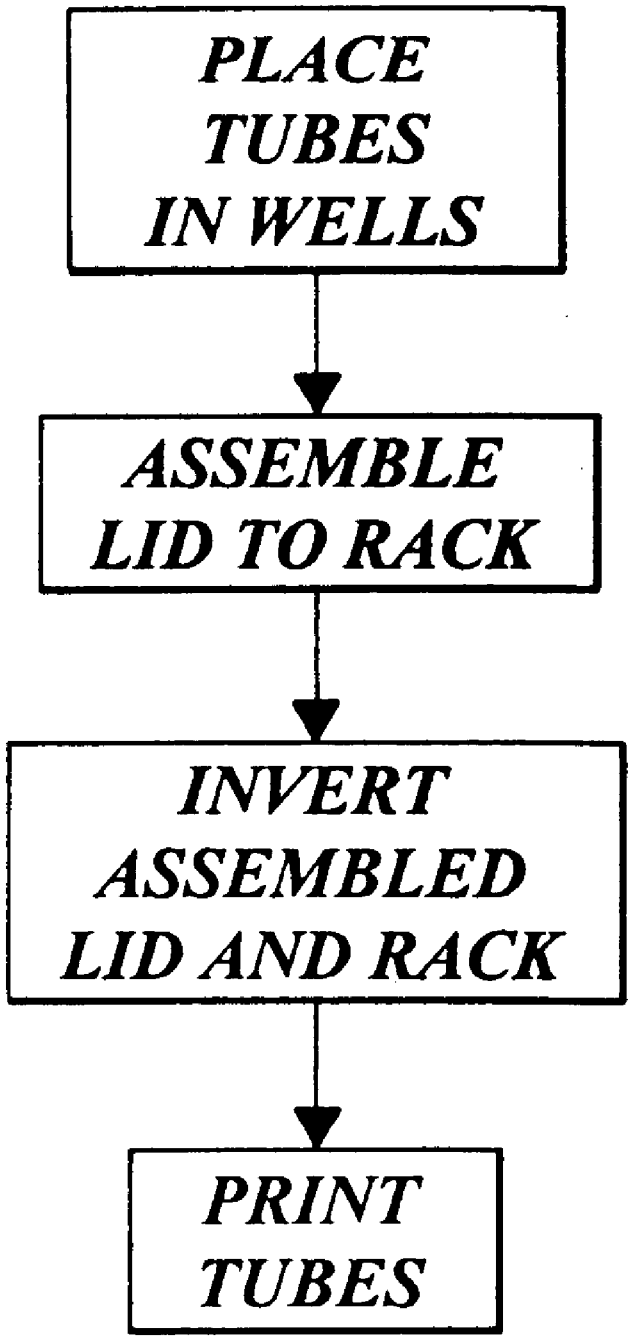
FIG. 5 is a block diagram illustrating the steps of the method herein claimed.

With reference to FIG. 5, the method of applying indicia 32 to the test tubes is illustrated as comprising the following steps: unmarked test tubes 26 are placed in the wells 14; the lid 12 is secured to the rack; the assembled lid and rack are inverted to expose the lower tube ends; and the lower tube ends are printed with alphanumeric designations corresponding to the designations 20 along the edges 22 and 24 of the rack top surface.

By printing the tubes while they are positioned in the rack, one eliminates the possibility that a printed tube will be loaded into an incorrect position. Also, as all of the tubes are printed at one time, only one art set-up is required.

The tubes may be made of a polymeric material, specifically a polyolefin, and more specifically polypropylene or the tubes may be made of glass. The indicia printed on the tubes should be resistant to solvents, scratching, etc. To this end, the polypropylene tubes preferably are pretreated by corona discharge and placed under a flame before being pad printed. This pretreatment oxidizes the tube surface and thus optimizes its receptivity to the printed indicia.

Alternatively, the tubes may originally be positioned in a fixture having wells with open bottoms. The tubes are printed as described above, and after printing, are removed as a group from the fixture and placed into a second fixture. The second fixture may be a rack having close bottomed wells. The second fixture may also be a cartridge designed to hold the tubes during the printing process. The cartridge may then be provided to laboratory personnel who will employ the cartridge as an insert into racks already in their possession.

The foregoing description has been limited to a specific embodiment of the invention. It will be apparent, however, that variations and modifications can be made to the invention, with the attainment of some or all of the advantages. For example, the number of wells in the rack may be altered or the array may only include letters rather than numbers or another printing or marking method may be utilized. Therefore, it is the object of the claims to cover all such variations and modifications as come within the true spirit and scope of the invention.

Having described the invention, what is now claimed is:

1. A method of uniquely identifying a plurality of discrete test tubes, said method comprising the steps of:

a) providing a rack having an array of wells with open bottoms, said wells being located at the intersections of mutually perpendicular columns and rows and being configured and dimensioned to receive single test tubes, said rack having first indicia identifying said columns and second indicia identifying said rows, each well thus being identifiable by reference to the first and second indicia identifying its respective intersecting column and row;

b) positioning a plurality of said test tubes in said wells, said test tubes having open tops and closed lower ends protruding through the open bottoms of said wells; and c) applying said first and second indicia to the respective closed lower ends of the test tubes positioned in said wells, the application of said first and second indicia being performed in situ and simultaneously as a single step to all of the test tubes in said wells, thereby resulting in each test tube being uniquely identified with reference to its respective well.

2. The method of claim 1, wherein said first indicia is alphanumeric.

3. The method of claim 1, wherein said second indicia is alphanumeric.

4. The method of claim 1, further comprising detachably coupling lid to said rack.

5. The method of claim 1, wherein said second indicia is pad printed.

6. The method of claim 5, wherein said test tubes are formed of polypropylene and further comprising pretreating the lower ends of said test tubes to oxidize the surfaces thereof before printing said second indicia thereon.

7. A method of uniquely identifying a plurality of discrete test tubes, said method comprising the steps of:

a) providing a fixture having an array of through openings located at the intersections of mutually perpendicular columns and rows;

b) positioning a plurality of test tubes having closed lower ends in said openings;

c) applying first and second indicia to the lower ends of the thus positioned test tubes, said first indicia identifying said columns and said second indicia identifying said rows, with the first and second indicia applied to the lower ends of said test tubes corresponding to the first and second indicia identifying the intersecting columns and rows of the openings in which said test tubes are positioned, the application of said indicia being performed in situ and simultaneously as a single step to all of the test tubes in said openings;

d) removing said test tubes from said fixture; and e) arranging said test tubes in a rack having an array of wells, said wells being located at the intersections of mutually perpendicular columns and rows and being configured and dimensioned to receive individual test tubes, said rack having said first indicia identifying the columns of said wells and said second indicia identifying the rows of said wells, with each well thus being identifiable by reference to the first and second indicia identifying its respective intersecting column and row, said test tubes being positioned in the wells identifiable by the first and second indicia on the lower ends thereof.

8. The method of claim 7, wherein said first indicia is alphanumeric.

9. The method of claim 7, wherein said second indicia is alphanumeric.

10. The method of claim 7, further comprising detachably coupling a lid to said rack.

11. The method of claim 7, wherein said indicia is pad printed.

12. The method of claim 7, wherein said test tubes are formed of polypropylene and further comprising pretreating the lower ends of said test tubes to oxidize the surfaces thereof before printing said first indicia thereon.

13. Apparatus for uniquely identifying a plurality of discrete test tubes, said apparatus comprising:

a rack having an array of wells with open bottoms located at the intersections of mutually perpendicular columns and rows, each well being configured and dimensioned to receive a single test tube; first and second indicia on said rack, said first indicia identifying said columns and said second indicia identifying said rows, said wells being identifiable by reference to the first and second indicia identifying their respective intersecting columns and rows, said test tubes being positioned in the wells of said rack and having closed lower ends protruding through the open bottoms of the said wells, said test tubes being uniquely identified by an in situ simultaneous single step application to all of the closed lower ends thereof of the first and second indicia identifying the intersecting columns and rows of their respective wells.

14. The apparatus of claim 13, wherein said first indicia is alphanumeric.

15. The apparatus of claim 13, wherein said second indicia is alphanumeric.

16. The apparatus of claim 13, wherein said rack further comprises a lid detachably coupled to said rack at a position overlying the test tubes in said wells.

17. The apparatus of claim 13, wherein said test tubes are made of a polymeric material.

18. The apparatus of claim 13, wherein said polymeric material is a polyolefin.

19. The apparatus of claim 18, wherein said polyolefin is polypropylene.

20. The apparatus of claim 13, wherein said test tubes are made of glass.

* * * * *